US010398215B2

(12) United States Patent
Kim et al.

(10) Patent No.: US 10,398,215 B2
(45) Date of Patent: Sep. 3, 2019

(54) ADJUSTABLE END MASCARA BRUSH

(71) Applicant: AA R&D LLC, Leonia, NJ (US)

(72) Inventors: Yoon H. Kim, Leonia, NJ (US); Asher Kim, Leonia, NJ (US)

(73) Assignee: AA R&D LLC, Leonia, NJ (US)

( * ) Notice: Subject to any disclaimer, the term of this patent is extended or adjusted under 35 U.S.C. 154(b) by 0 days.

(21) Appl. No.: 15/649,019

(22) Filed: Jul. 13, 2017

(65) Prior Publication Data

US 2018/0249812 A1 Sep. 6, 2018

Related U.S. Application Data

(60) Provisional application No. 62/466,031, filed on Mar. 2, 2017.

(51) Int. Cl.
*A46B 5/00* (2006.01)
*A45D 34/04* (2006.01)
(Continued)

(52) U.S. Cl.
CPC ..... *A46B 5/0087* (2013.01); *A45D 34/04* (2013.01); *A45D 34/045* (2013.01); *A45D 40/26* (2013.01);
(Continued)

(58) Field of Classification Search
CPC ..... A45D 40/265; A46B 2200/1053; A46B 5/0083; A46B 5/0087; A46B 9/021; A46B 9/026
(Continued)

(56) References Cited

U.S. PATENT DOCUMENTS 585,549 A * 6/1897 Atwater ..... F16C 11/106 403/90
1,595,901 A * 8/1926 Mahler ..... A46B 5/0075 15/144.1
(Continued)

FOREIGN PATENT DOCUMENTS

CN 205813902 U 12/2016
EP 1369056 A1 12/2003
(Continued)

OTHER PUBLICATIONS

Notification of Tranmittal of the International Search Report and the Written Opinion of the International Searching Authority (Form PCT/ISA/220) issued in counterpart International Application No. PCT/US18/13822 dated May 14, 2018, with Forms PCT/ISA/210 and PCT/ISA/237. (10 pages).
(Continued)

*Primary Examiner* — Tatiana L Nobrega
*Assistant Examiner* — Jennifer F Gill
(74) *Attorney, Agent, or Firm* — Westerman, Hattori, Daniels & Adrian, LLP

(57) ABSTRACT

A cosmetic applicator is provided. The cosmetic applicator comprises a grip, a holder shaft that extends from the grip, an applicator region that is connected to the holder shaft by means of an articulation, and a ball stud. The applicator region pivots at a desired angle of up to 90° arounds its axis, and is adjusted to any desired angles off a longitudinal axis of the cosmetic applicator in any direction around the axis, and the ball stud has a stopper or a protrusion at the opposite end.

7 Claims, 4 Drawing Sheets

(51) Int. Cl.
*A45D 40/26* (2006.01)
*A46B 9/02* (2006.01)

(52) U.S. Cl.
CPC ..... *A45D 40/265* (2013.01); *A46B 5/0083* (2013.01); *A46B 9/021* (2013.01); *A46B 9/026* (2013.01); *A46B 2200/1053* (2013.01)

(58) Field of Classification Search
USPC ..... 132/218
See application file for complete search history.

(56) References Cited

U.S. PATENT DOCUMENTS

| | | | | |
|---|---|---|---|---|
| 1,779,057 | A * | 10/1930 | Tolmach | A46B 5/0075 15/144.2 |
| 3,495,858 | A | 2/1970 | Kindel | |
| 4,796,325 | A | 1/1989 | Bortman | |
| 9,339,098 | B2 | 5/2016 | Takata et al. | |
| 2004/0009028 | A1 | 1/2004 | Gueret | |
| 2004/0035437 | A1 | 2/2004 | Gueret | |
| 2005/0034257 | A1* | 2/2005 | Ponzini | A46B 5/0075 15/167.1 |
| 2007/0056603 | A1* | 3/2007 | Huh | A45D 33/008 132/294 |
| 2011/0067187 | A1* | 3/2011 | Pegross | A46B 5/0012 15/23 |
| 2011/0083289 | A1* | 4/2011 | Heatley-Adams | A61C 17/222 15/22.2 |
| 2011/0135376 | A1* | 6/2011 | Weigel | A45D 40/24 401/29 |
| 2011/0135476 | A1 | 6/2011 | Olesen | |
| 2014/0016984 | A1* | 1/2014 | Kim | A45D 40/265 401/129 |
| 2015/0020835 | A1* | 1/2015 | Takata | A45D 40/265 132/200 |
| 2015/0020836 | A1 | 1/2015 | Ramet et al. | |
| 2016/0128457 | A1* | 5/2016 | Lim | A46B 5/0033 401/118 |
| 2016/0207190 | A1* | 7/2016 | Balz | A46B 5/0095 |
| 2017/0181524 | A1 | 6/2017 | Thiebaut et al. | |

FOREIGN PATENT DOCUMENTS

| | | | |
|---|---|---|---|
| EP | 2789259 | A1 | 10/2014 |
| GB | 216735 | A | 6/1924 |
| JP | 2011-115589 | A | 6/2011 |
| KR | 10-2011-0107224 | A | 9/2011 |
| KR | 1020120031213 | A | 3/2012 |
| KR | 101228255 | B1 | 1/2013 |
| KR | 1020130014648 | A | 2/2013 |
| WO | 2016/135270 | A1 | 9/2016 |

OTHER PUBLICATIONS

Notification of Transmittal of the International Search Report and the Written Opinion of the International Searching Authority (Form PCT/ISA/220) issued in counterpart International Application No. PCT/US2018/025835 dated Jun. 11, 2018, with Forms PCT/ISA/210 and PCT/ISA/237. (9 pages).

Extended European Search Report dated Feb. 13, 2018, issued in counterpart European Application No. 17001236.3. (9 pages).

Office Action dated Aug. 17, 2018, issued in counterpart Korean Application No. 10-2017-0092146, with English translation (10 pages).

Final Office Action dated Apr. 1, 2019, issued in U.S. Appl. No. 15/940,092. (16 pages).

* cited by examiner

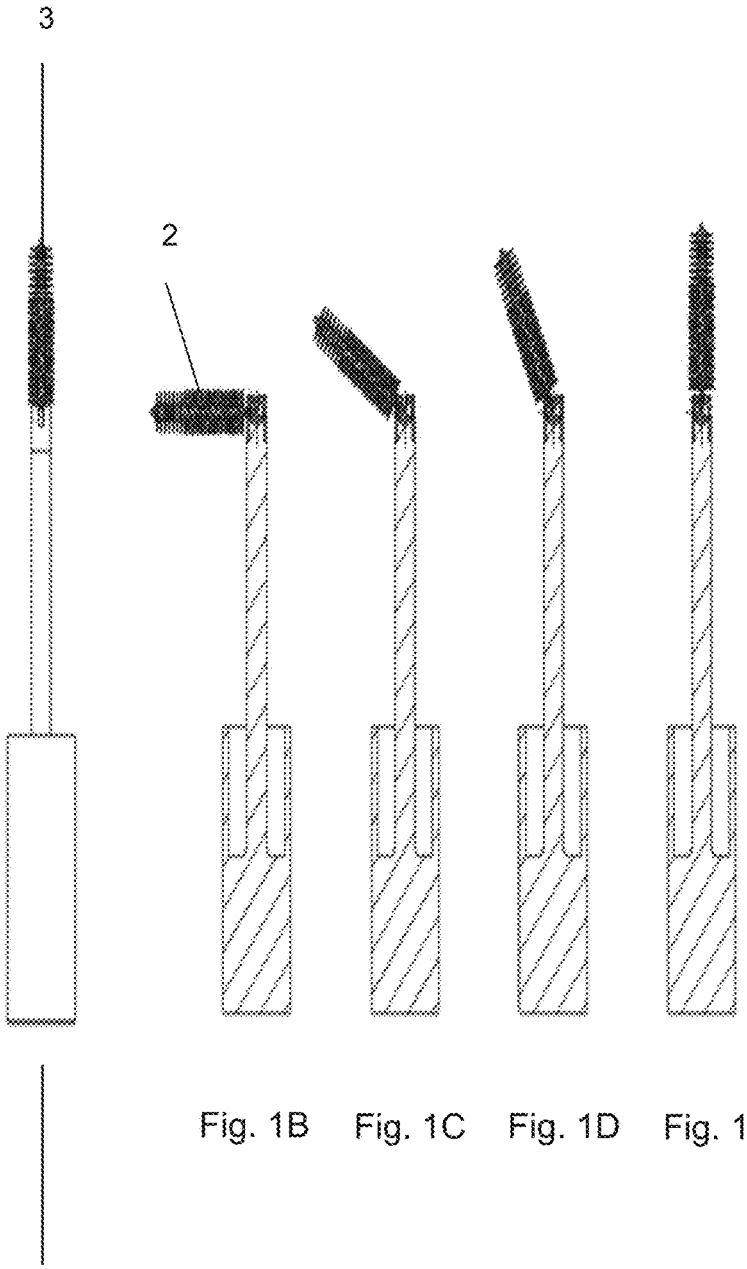
Fig. 1A
Fig. 1B Fig. 1C Fig. 1D Fig. 1E
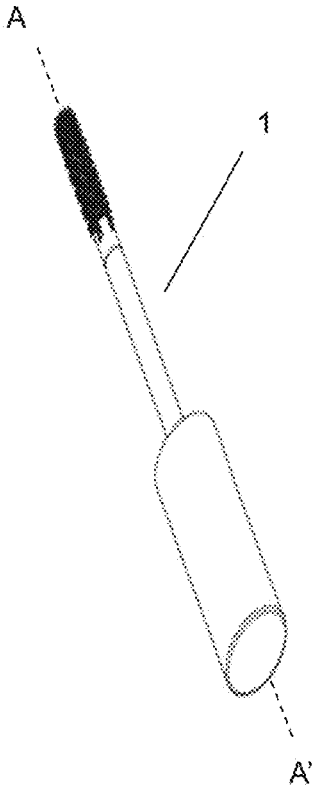
Fig. 1F

ADJUSTABLE END MASCARA BRUSH

RELATED APPLICATION

This application claims priority to U.S. Provisional Application No. 62/466,031, "Adjustable End Mascara Brush," filed Mar. 2, 2017, which application is incorporated by reference herein in its entirety.

FIELD OF THE INVENTION

The present invention relates to a cosmetic applicator. More particularly, the present invention relates a mascara brush, which is adjustable by means of an articulation and allows the user to apply mascara in an orientation that is more ergonomic. In addition, the mascara brush of the present invention enables the user to apply an adjustment to a brush head without the concern of the user to which orientation the brush is intended to be adjusted in.

BACKGROUND OF THE INVENTION

Mascara applicators are used to apply various colors of mascara liquids to eyelashes to enhance the eyes. The mascara applicator largely includes a handle and a brush, onto which mascara liquid is applied.

So as to apply the mascara liquid to the user's eyelashes, first, the brush is inserted into a mascara case into which the mascara liquid is contained and is coated with the mascara liquid, and next, the brush is rotated on the eyelashes to raise the eyelashes upwardly, so that the mascara liquid is applied fully to the eyelashes to make them curvedly erected.

However, the above-mentioned conventional mascara has the handle and the brush arranged in a straight line, which may not be comfortable with many users.

For example, the make-up is conducted in the state, where the eyelashes and the brush are arranged in a parallel with each other, and at this time, a user' arm should be raised to her shoulder's height to make the brush located in parallel with her eyelashes, which causes her make-up operation to be performed in an unstable posture, thereby resulting in bad make-up.

Furthermore, while Patent Document 1 shows that the brush can pivot an angle of 90°, but the brush cannot be pivoted stably at a desired angle by the user and cannot be adjusted to any desired angles off a longitudinal axis of the cosmetic applicator in any direction around the axis (360°).

Patent Document 1: U.S. Pat. No. 9,339,098

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings:

FIGS. 1A-1F are views of a cosmetic applicator, which is adjustable by means of an articulation in accordance with a preferred embodiment of the present invention. FIG. 1A is a side view, FIG. 1B is a cross-section of FIG. 1A with the head bent at 90°, FIG. 1C is a cross-section of FIG. 1A with the head bent at 60°, FIG. 1D is a cross-section of FIG. 1A with the head bent at 30°, and FIG. 1E is a cross-section of FIG. 1A with the head bent at 0°. FIG. 1F is a bottom view.

DETAILED DESCRIPTION OF THE INVENTION

Figure 2A:
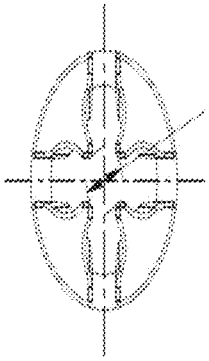
FIGS. 2A-2E are views of an eye of a cosmetic applicator, which is adjustable by means of an articulation in accordance with a preferred embodiment of the present invention.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Adjusting a Cosmetic Applicator without any Mechanisms

A cosmetic applicator has an applicator region, which can be adjusted to any desired angles off a longitudinal axis of a brush in any direction around an axis. The applicator region is joined at the end to an applicator stem by a ball-joint connection, where the user pivots the applicator region to a desired angle. Unlike conventional ball-joints, where a pivot angle about the axis is limited, the applicator's ball-joint is designed to have a greater range of angular adjustments.

The applicator region pivots at an angle of up to 90° around its axis in order for the user to apply composition while holding the applicator at its grip in an orientation that is more natural and ergonomic to the wrist of the user.

Figure 2B:
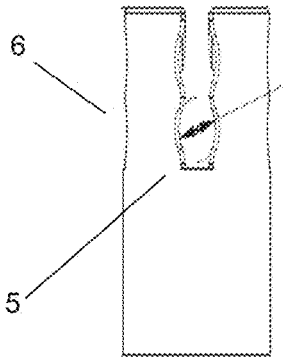
Figure 2C:
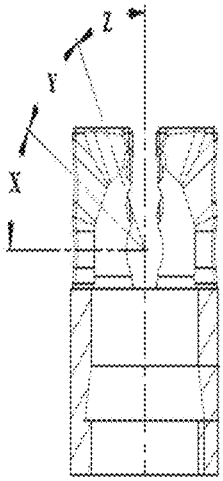
Figure 2D:
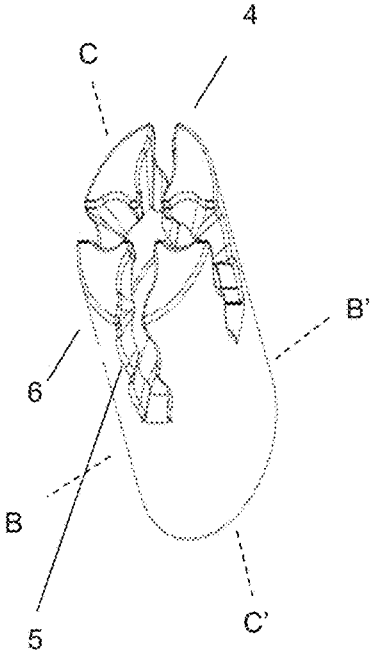
Figure 2E:
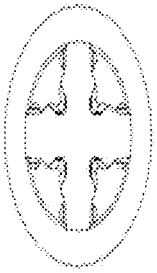
Figure 3A:
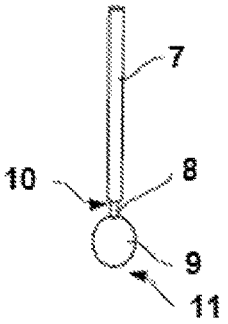
FIGS. 3A-3E are views of a cosmetic applicator consisting of a grip, a holder shaft, an eye, a seal, a stopper, a ball stud, a shaft anchor, a neck, and a brush shaft in accordance with another embodiment of the present invention.
Figure 3B:
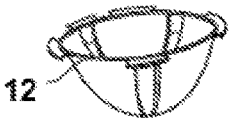
Figure 3D:
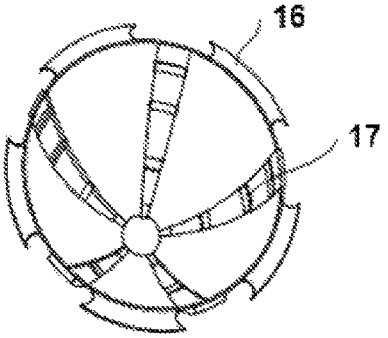
Figure 3C:
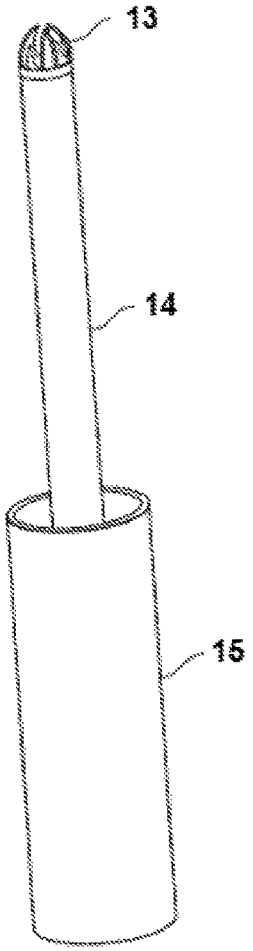
Figure 3E:
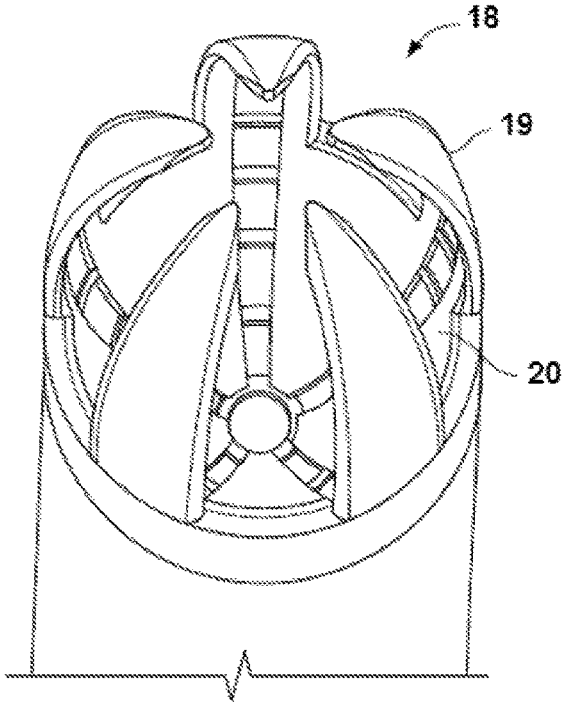
Figure 4:
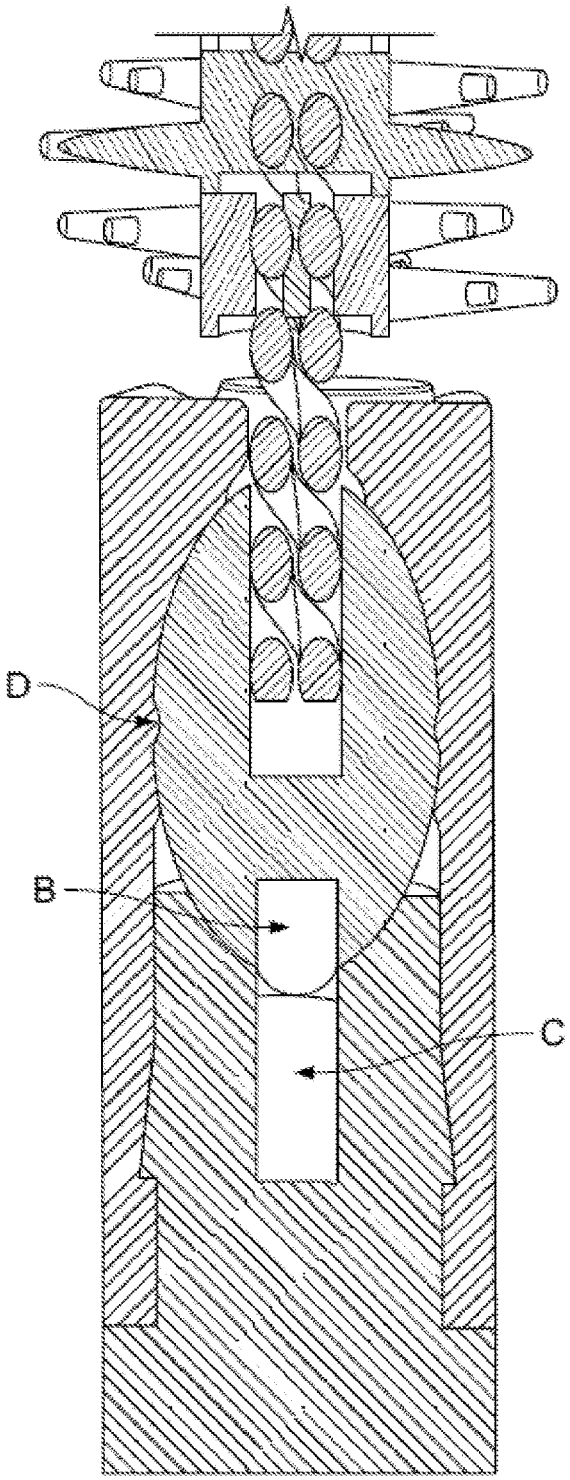
FIG. 4 is a cross-sectional view of a cosmetic applicator, which is adjustable by means of an articulation in accordance with a preferred embodiment of the present invention.

FIGS. 1A-1F and 2A-2E show various components of a cosmetic applicator 1 with a preferred design. FIGS. 1B-1E show that the applicator region 2 pivots at an angle of up to 90° around its axis 3 with an interval of 30°. FIG. 1A is a side view, FIG. 1B is a cross-section of FIG. 1A with the head bent at 90°, FIG. 1C is a cross-section of FIG. 1A with the head bent at 60°, FIG. 1D is a cross-section of FIG. 1A with the head bent at 30°, and FIG. 1E is a cross-section of FIG. 1A with the head bent at 0°. FIG. 1F is a bottom view. The plane upon which FIG. 1A through 1E is taken is indicated in FIG. 1F by the broken lines A and A'. However, this interval is not limited to these angles. The interval can be designed with any desired angles. In addition, FIG. 2D shows that an eye 4 of the cosmetic applicator has multiple slots 5 along petals 6 of the eye. The plane upon which FIGS. 2A and 2E is taken is indicated in FIG. 2D by the broken lines B and B'. The plane upon which FIGS. 2B and 2C is taken is indicated in FIG. 2D by the broken lines C and C'. These slots can be designed such that the applicator region pivots and positions stably at the desired interval (angles). For example, each of angles X, Y, and Z can be 30°, as shown in FIGS. 1B-1E. However, these angles are not limited to 30°. In addition, the number of slots is not limited to three, as shown in FIGS. 2A-2E. These slots can be made of any materials, such as rubber, and designed with any shapes, that can hold the applicator region stably and can be moved to the next slot easily by the user. In FIGS. 3A-3E, a cosmetic applicator comprises a brush shaft 7, a shaft anchor 8, a ball stud 9, a neck 10, a stopper 11, a seal 12, an eye 13, a holder shaft 14, and a grip 15. In addition, a seal 16 includes a holder 17, and an eye 18 includes petals 19 and pathways 20. The present invention also shows a ball stud and a stopper of the cosmetic applicator. Here, the stopper is used for the user to insert the applicator region (brush) easily into the mascara case by having the stopper be inserted into a hole. That is, the stopper enables the user to have the handle and the brush (applicator region) arranged in a straight line. The present invention shows the stopper formed on the ball stud, which is inserted to the hole. However, the hole can be formed on the ball stud, and a protrusion (stopper) can be formed inside the eye. The magnetic force can be used to attract the stopper into the hole so that the user can easily straighten the handle and the brush, as shown in FIG. 4. In FIG. 4, a metallic material is inserted inside the ball stud (B), and a magnetic material is inserted inside the eye (C) or vice versa. Finally, a circular indentation/protrusion D can be formed around the ball stud in addition to the stopper, so that the handle and the brush can be straightened easily by the user. The plane upon which FIG. 4 is taken is indicated in FIG. 1F by the broken lines A and A'.

In the present invention, the cosmetic applicator has a socket, which retains a ball-stud having a depth that is less than that of a hemisphere. A brim of walls of the semi-hemisphere rises up to (and supports) a neck of the applicator region, when the axis of the applicator region is perpendicular to that of the holder shaft.

To physically constrain the ball-stud within the socket, the cosmetic applicator has an upper portion, which resembles the shape of petals or leaves of a flower. These petals, having a radial symmetry around the axis, sit at the brim of the lower semi-hemisphere, giving the socket the shape of a hollow inner sphere. The edges of these petals guide the neck of the applicator region, when a pivot moment is applied, guiding a "stopper" of the ball-stud to follow along in channeled grooves along the inner walls of the socket.

The cosmetic applicator has five sectional "petals" protruding from the brim of the lower semi-hemisphere to retain the ball-stud within the socket. Five open sections allow the applicator region to pivot in a direction around the axis in 72° segments while being guided by the "petals" and the channeled pathways. This preferred method allows the user to adjust the applicator region to their discretion in any direction around the axis of the applicator without the concern of which correct orientation the applicator needs to be in prior to adjustments.

The cosmetic applicator has the ball-stud, which has the shape of a polygonal sphere and the socket taking shape that is consistent with it. Each face of the polygonal sphere fixes in position to the pivot angle (i.e., octagon will have angular adjustments in increments of 45°).

In order to hold the applicator region to each angular position about the longitudinal axis of the applicator, the ball-stud "stopper" works in conjunction with the cavities or ridges that are placed along the grooves of the inner walls of the socket. Ridges or cavities are placed in increments to fix the applicator region to each angle ranging from 0° (upright) to 90° (bent) until a breakaway moment is applied by the user. Breakaway moment shall be no greater than the force applied by the simple "flick" of the user's wrist. This is because a great amount of holding force is unnecessary due to the nature what the applicator is used for, namely, mascara composition applied to the eyelashes.

In the present invention, the cosmetic applicator has a dual ball-joint movement, which works independently to each other and each with its own limitations. A connector arm with ball-studs at each end is a connecting point of the applicator region to the holder shaft. The holder shaft is similar to above embodiments with a grip and socket opposite to the end of grip. The holder shaft socket has a cavity, whose depth is greater than that of a hemisphere. The socket seats the ball-stud (lower joint) within its cavity and constrains the ball-stud within its pocket. Limitations of cone axis (pivot angle off longitudinal axis of applicator) of each ball joint may have a difference, but the combined pivot angle of applicator region to holder shaft shall be no greater nor less than perpendicular (90°).

Second ball-joint (upper joint) at the opposite end to holder shaft ball-joint has a size and/or shape that may differ. Ball-joint attaches to socket of applicator region, in which applicator region has a means of securing to the socket. Socket has a depth, which is greater to that of a hemisphere and constrains the ball-stud within its cavity.

Similar to the above embodiments, the ball-studs at each end of the connector arm has a "stopper" or protrusion that functions to hold the position of the ball stud until a breakaway moment is applied. However, a guide is not necessary, as the ball-joint has more degrees of freedom in each plane when compared with the previous embodiments. The "stopper" of each ball-stud fits in one of the many dimples or cavities arranged along the walls of the each respective socket. Dimples are arranged to have radial symmetry around the axis of the socket, providing the joint with a diverse set of holding positions.

For an adjustable brush fixed to the end of a cosmetic wand where the user makes adjustments using the container, the brush can be plastic injected, nylon twist, or mono/bi-injection molded.

The mascara brush consists of a brush shaft, a ball stud or "sphere," a shaft anchor, a holder assembly (shaft), and a seal.

The brush shaft is fixed to the ball stud using the shaft anchor. The shaft anchor may or may not be used. There are other ways of fixing the brush shaft onto the ball stud. For the brush shaft or brush, the brush may be injection molded or nylon twist or molded twist. The brush shaft may be a twisted metal core or polymer shaft. The brush shaft has projections encompassing the core (bristles) of nylon or polymer.

In the present invention, the ball stud or "sphere" is connected to the holder shaft via ball-joint. The ball stud may or may not be a sphere, as it may take form of other shapes as well. The ball stud has protrusion(s) or "stopper" at the opposite end to where the brush shaft securely fits to. The stopper works in conjunction with grooved pathway and cavities along the wall of joint-socket or "eye".

In the present invention, the holder shaft may or may not be an assembly. It takes in form of a mascara applicator, which includes a grip and a shaft that extends from the grip. A socket or "eye" at the end of shaft attached to the grip allows the ball stud to be securely pocketed and allows for a smooth transition of adjustments.

In the present invention, the "eye" acts as a socket for the ball stud to fit securely into and allows adjustments to be made in any direction similar in functionality to a ball-joint. Unlike ball-joints that are limited in their range of adjustments, the "eye" and ball stud connection allows movements to be made in a greater range of adjustments in all directions around the axis.

The "eye" may or may not be a part to the assembly to the holder shaft (assembly). The "eye" may be made of polymer, metal, and etc. The "eye" may have a shape that is consistent to the shape of ball stud and fit the ball stud securely to the holder (assembly). The "eye" has sides or curves consistent with that of ball stud. (i.e., a spherical ball stud has an "eye" of a hollow sphere.)

The size of ball stud to size of the interior walls of the "eye" may or may not be of similar sizes; there may be a slight offset. (i.e., a radius of ball stud to radius of inner walls of socket may have offset.)

In the present invention, the "eye" socket may have walls of different thicknesses covering the ball stud at different heights around the ball. The "eye" socket may fully or partially encompass the radius of ball and at different thicknesses. The "eye's" inner radius may have an offset in accordance with radius of spherical ball stud. This allows for tolerance and fitting of seal. The "eye" has "petals" that reach over the seated ball-stud to constrain the ball stud within the socket and has edges, which guide the "neck" of the brush stem during adjustments.

In the present invention, the "eye" has channeled pathways molded or cut into the inner concavity of the "eye". These channels, in conjunction with the "petal" edges, provide a guide for the "stopper" during transition, allowing the user to smoothly adjust the angle. Grooves also have smaller cavities or pockets that fixate the pivot angle of the brush at any longitudinal direction. There may be multiple set of cavities for each direction.

The "eye" may or may not have channeled pathways, but has a method to allow smooth pivotal transitions of the brush similar to a ball joint and will not have any angular limitations or restrictions.

The "eye" houses the ball stud and secures it either by securing the ball stud within its cavity as a socket or by magnets (magnetic force), brackets, or grooves.

The "eye" has a method to fix brush angle at user discretion in all set or in all directions and in set or in all angles. In addition, the "eye" may have thin walls with wedged sections encircling the brim of the hollow half sphere that concave inwards to form a hollow sphere socket. Wedges function to retain the ball stud within the cavity when in motion.

The "eye" may have slots along the wall of the socket to allow the brush to be angled up to (but not limited to) 90°. In addition, the "eye" may or may not have a seal made of rubber, silicone, plastic, and etc.

Adjusting a Cosmetic Applicator with any Mechanisms

A cosmetic applicator has an applicator region, which can be adjusted to any desired angle off a longitudinal axis of a brush in any direction around an axis with mechanisms.

In the present invention, the user pushes button situated at the end of the holder to retract a locking pin on top, holding the brush position in place. Once button is depressed, the locking pin retracts into the holder stem, allowing the use to apply moment to the brush to a desired angle.

In the present invention, the user pulls the knob situated at the bottom end of the holder, which in turn retracts the locking pin into the holder stem. Once locking pin is retracted, a moment force may be applied by the user to adjust the brush position to a desired angle.

In the present invention, the user twists the knob situated at the end of the holder to retract the locking pin into the holder stem. Once locking pin is retracted releasing the angular position of the brush, the user may apply a moment force to the brush to adjust the position to a new desired angle.

Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

Advantageous Effect of the Present Invention

The present invention shows various example of a cosmetic applicator, which is adjustable by means of an articulation, described in the present invention.

The advantages of the present invention will be apparent to those skilled in the art from the foregoing specification.

For example, the users can apply mascara in an orientation that is more ergonomic at their desired angles with or without any mechanisms. The users also can use the entire surface of brush (360°) when applying the mascara. The users' arm does not have to be raised her shoulder's height to make the brush located in parallel with her eyelashes, causing her make-up operation to be performed in a very stable posture and resulting in excellent make-up at her desired facial locations. After the users are finished with applying the mascara, the users can easily insert the brush into the mascara case.

The cosmetic applicator is not limited to mascara. The cosmetic applicator of the present invention can be extended to eyeliner, blusher, eyeshadow, lip gloss, and etc.

What is claimed is:

1. A cosmetic applicator for applying a cosmetic to eyelashes comprising:

a grip;

a holder shaft that extends from the grip, the holder shaft comprising a longitudinal axis; and an applicator region, one end of the applicator region being connected to a ball stud, wherein the applicator region pivots at a desired angle of up to 90° around the longitudinal axis, and is adjusted to any directions off the longitudinal axis, wherein the ball stud is connected to the holder shaft, wherein the holder shaft comprises an eye which acts as a socket for the ball stud to fit securely into and allows adjustments to be made in any direction, wherein the eye comprises a plurality of petals spaced radially apart from one another that constrain the ball stud within the socket, wherein the eye comprises a plurality of longitudinally tapered and channeled pathways in an inner cavity of the eye, wherein these channeled pathways extend outwardly from a central annulus in the inner cavity of the eye, wherein together the channeled pathways and the central annulus form a starburst shape with an end of each arm of the starburst terminating at a free end of each petal, and wherein edges of the plurality of petals guide the one end of the applicator region, which is connected to the ball stud, during adjustments.

2. The cosmetic applicator according to claim 1, wherein the applicator region further comprising:

a brush shaft, wherein the brush shaft is fixed to the ball stud.

3. The cosmetic applicator according to claim 1, wherein the eye houses the ball stud and secures the ball stud by magnets, brackets, or grooves.

4. The cosmetic applicator according to claim 1, wherein the eye comprises a plurality of slots along each of the plurality of petals, and the plurality of slots secure the applicator region.

5. The cosmetic applicator according to claim 1, wherein the ball stud has a stopper or a protrusion at its bottom portion.

6. The cosmetic applicator according to claim 5, wherein a circular indentation or protrusion is formed around the ball stud in addition to the stopper.

7. A cosmetic applicator comprising: a grip; a holder shaft that extends from the grip, the holder shaft comprising a longitudinal axis; and an applicator region, one end of the applicator region being connected to a ball stud, the applicator region further comprising: a brush shaft fixed to the ball stud, and wherein the applicator region pivots at a desired angle of up to 90° around the longitudinal axis, and is adjusted to any directions off the longitudinal axis, wherein the ball stud is connected to the holder shaft, wherein the holder shaft comprises an eye which acts as a socket for the ball stud to fit securely into and allows adjustments to be made in any direction, wherein the eye comprises a plurality of petals spaced radially apart from one another that constrain the ball stud within the socket, wherein the eye comprises a plurality of longitudinally tapered and channeled pathways in an inner cavity of the eye, wherein these channeled pathways extend outwardly from a central annulus in the inner cavity of the eye, wherein together the channeled pathways and the central annulus form a starburst shape with an end of each arm of the starburst terminating in a free end of each petal, and wherein edges of the plurality of petals guide the one end of the applicator region, which is connected to the ball stud, during adjustments.

* * * * *